US009808035B2

(12) United States Patent
Kido et al.

(10) Patent No.: US 9,808,035 B2
(45) Date of Patent: Nov. 7, 2017

(54) CLOTHING

(71) Applicant: Toray Industries, Inc., Tokyo (JP)

(72) Inventors: Tatsuya Kido, Tokyo (JP); Yasushi Fujita, Tokyo (JP); Motoko Kameda, Tokyo (JP); Michiko Yoshida, Tokyo (JP)

(73) Assignee: Toray Industries, Inc. (JP)

( * ) Notice: Subject to any disclaimer, the term of this patent is extended or adjusted under 35 U.S.C. 154(b) by 587 days.

(21) Appl. No.: 14/374,349

(22) PCT Filed: Jan. 17, 2013

(86) PCT No.: PCT/JP2013/050746
§ 371 (c)(1),
(2) Date: Jul. 24, 2014

(87) PCT Pub. No.: WO2013/111660
PCT Pub. Date: Aug. 1, 2013

(65) Prior Publication Data

US 2014/0366241 A1 Dec. 18, 2014

(30) Foreign Application Priority Data

Jan. 26, 2012 (JP) ..... 2012-013827

(51) Int. Cl.
*A41B 1/08* (2006.01)
*A41D 13/00* (2006.01)

(52) U.S. Cl.
CPC ..... *A41B 1/08* (2013.01); *A41D 13/0015* (2013.01); *A41D 2400/38* (2013.01)

(58) Field of Classification Search
CPC ... A41B 1/08; A41D 13/0015; A41D 2400/38
See application file for complete search history.

(56) References Cited

U.S. PATENT DOCUMENTS

| | | | | |
|---|---|---|---|---|
| 5,957,878 | A * | 9/1999 | Gilliam | A41D 13/0015 128/856 |
| 2009/0077708 | A1* | 3/2009 | Takamato | A41D 1/04 2/69 |
| 2012/0233752 | A1* | 9/2012 | Kemma | A41D 1/084 2/465 |

FOREIGN PATENT DOCUMENTS

| | | | |
|---|---|---|---|
| JP | 2001-164401 | A | 6/2001 |
| JP | 2002-212813 | A | 7/2002 |
| JP | 2006-161207 | A | 6/2006 |
| JP | 2007-138335 | A | 6/2007 |
| JP | 4431616 | B2 | 3/2010 |
| JP | 2010-095803 | A | 4/2010 |
| JP | 2010-189795 | A | 9/2010 |
| JP | 2011-144462 | A | 7/2011 |

* cited by examiner

*Primary Examiner* — Shaun R Hurley
*Assistant Examiner* — Andrew W Sutton
(74) *Attorney, Agent, or Firm* — DLA Piper LP (US)

(57) ABSTRACT

Clothing has a body including a front body and a back body, wherein a material constituting the front body and a material constituting the back body are the same, and a chest width of the back body is shorter than a chest width of the front body. The clothing guides a motion or state of the upper body of a wearer to a proper posture and improves motion followability and wearing comfort around scapulae.

13 Claims, 11 Drawing Sheets

CLOTHING

TECHNICAL FIELD

This disclosure relates to a clothing capable of guiding a motion or state of the upper body of a wearer to a proper posture.

BACKGROUND

In recent years, for the purpose of health promotion and figure improvement, an idea has become popular which is the idea of reducing tension of muscles which leads to stiff shoulders and the like by improving postures such as stooping by straightening up the back and keeping a bodily state in a standing position vertical to stick out the chest. Functional clothing has been marketed, the wearing of which provides the state where the chest is stuck out by straightening up the back and keeping a bodily state in a standing position vertical. Such functional clothing is capable of applying a different load depending on the body site, for example, drawing left and right scapulae to the rear central part of a human body by utilizing a stretching stress of a material.

As such functional clothing, for example, those which have an upper body part, use a tight-fit knitted/woven fabric, and are designed to guide the posture of a wearer to a proper state are known. In particular, those which apply a different load depending on the body site by using materials having a different elongation are known. The functional clothing is intended to provide good posture in appearance by facilitating straightening up of the back using a stretching stress of a clothing material, and materials having a high stretching stress have been used to increase such an effect.

Thus, many of the functional clothing on the market tighten up and apply firm pressure when worn. They are suitable for short-time use, for example, wearing only during sports activities, and are poor in comfort during long-time use. In addition, tightening of the clothing affects the ease of putting on and taking off, placing a burden on wearers such as being caught midway in putting on and taking off.

Examples of disclosed techniques relating to functional clothing include varying strength from site to site by using a combination of materials having a different stretching stress and disposing the material having a high stretching stress at a region from superior angle of scapula to angulus inferior (Japanese Patent No. 4431616 and JP 2006-161207 A), varying strength from site to site by using a difference between lengthwise and crosswise loads for stretching caused by changing the cutting direction of a fabric (JP 2001-164401 A), varying strength from site to site by laminating a strain material on a main fabric (JP 2010-095803 A), and varying strength from site to site by using same fabrics with a different texture (JP 2007-138335 A).

However, in the techniques of JP '616, JP '803 and JP '207 wherein a combination of different materials is used to vary strength from site to site, it is necessary to use at least two different materials, a strain material and a main material and, since there is a limitation on the combination of materials that can be used, various materials cannot be used freely. In other words, the variety of materials is narrow. In addition, since it is necessary to use two different materials, the productivity is poor.

In the technique of JP '401 wherein the cutting direction is changed, diagonal cutting such as bias cutting increases the amount of fabric used, i.e., the necessary length of fabric, leading to poor productivity. In addition, a difference in the rate of measurement change after washing due to the cutting direction can occur in the same direction of a clothing, resulting in deformation and the like.

In the technique of JP '335 wherein same fabrics with a different texture are used, it is necessary to knit a clothing on a one-by-one basis because the texture is partly varied by changing the knit, and thus this technique is suited for low-volume manufacturing and poor in productivity.

As described above, none of the conventional functional clothing can provide sufficient performance in variety, productivity, and wearing comfort of the material.

SUMMARY

We thus provide:

Clothing having a body including a front body and a back body, wherein a material constituting the front body and a material constituting the back body are the same, and a chest width of the back body is shorter than a chest width of the front body.

The back body is composed of a plurality of back body parts joined, wherein the plurality of back body parts preferably has such a shape that a cutting out portion is formed when these back body parts are arranged in a plane without being joined, and when the plurality of back body parts is joined, a joint region closing the cutting out portion preferably passes from superior angle of scapula to angulus inferior scapulae of a human body between the left scapula and the right scapula.

The ratio of the chest width of the front body to the chest width of the back body (chest width of front body/chest width of back body) is preferably 1.1 or more.

An elongation 2 of the back body as determined by the following equation is preferably greater than an elongation 1 of the front body as determined by the following equation, and in the materials constituting the front body and the back body, a stretching stress 2 in the chest width direction at the elongation 2 is preferably greater than a stretching stress 1 in the chest width direction at the elongation 1:

Elongation 1(%)={(intermediate value in chest or bust measurement range of a specific clothing size specified in a specific clothing standard/2)−chest width of front body}/chest width of front body×100; and Elongation 2(%)={(intermediate value in chest or bust measurement range of a specific clothing size specified in a specific clothing standard/2)−chest width of back body}/chest width of back body×100, wherein "a specific clothing size specified in a specific clothing standard" is a clothing standard and a clothing size used as a standard in designing the clothing.

The stretching stress 1 is preferably 1 to 30 gf/cm (980 to 29,400 dyn/cm), and the stretching stress 2 is preferably 20 to 100 gf/cm (19,600 to 98,000 dyn/cm).

The materials constituting the front body and the back body preferably have an elongation 3 in the chest width direction at 14.7 N elongation of 70% or more.

The ratio of the elongation 3 in the chest width direction to the elongation 3 in the body length direction at 14.7 N elongation (elongation 3 in chest width direction/elongation 3 in body length direction) of the materials constituting the front body and the back body is preferably 0.5 to 2.0.

The materials constituting the front body and the back body preferably have an elastic recovery of elongation after 14.7 N elongation of 85 to 100% in the chest width direction.

The total measurement of the chest width of the front body and the chest width of the back body is preferably lower than the lower limit of a chest or bust measurement range of a specific clothing size specified in a specific clothing standard.

"A specific clothing size specified in a specific clothing standard" is a clothing standard and a clothing size used as a standard in designing the clothing.

The clothing can be composed of only one material while being capable of drawing left and right scapulae to the rear central part of a human body when worn. Thus, there is no need to use a plurality of materials, and in manufacturing the clothing, a step of combining a plurality of materials can be omitted. Further, a fabric producing step and a sewing step can be shortened to improve productivity. Further, the clothing in a preferred aspect of this disclosure can reduce the sensation of pressure, a factor of wearing comfort, and improve the ease of putting on and taking off.

DESCRIPTION OF SYMBOLS

Figure 1:
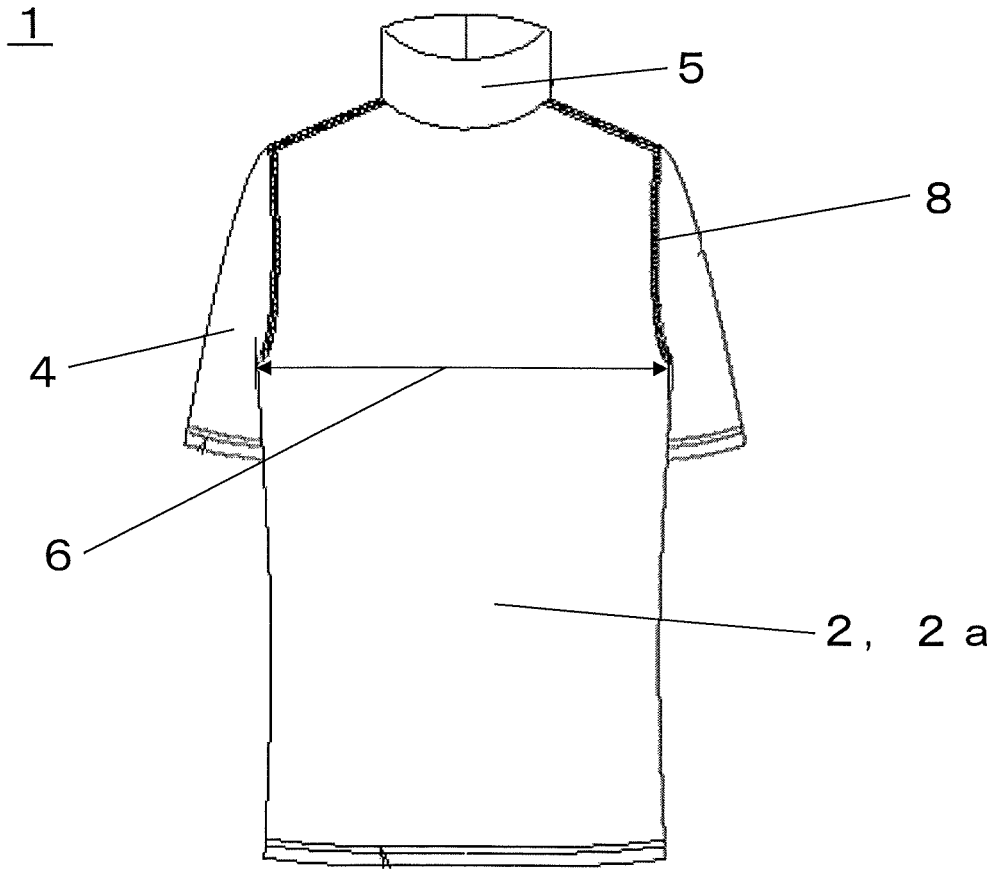
FIG. 1 is a front view of our clothing.

1: Clothing
2: Front body
2*a*: Front body parts
3: Back body
3*a*: Back body parts
4: Sleeve
5: Neck
6: Chest width of front body
7: Chest width of back body
7*a*: Chest width of divided back body
8: Joint region
9: Cutting out portion
10: Distance between angulus inside scapulae point
21: Scapula
21*a*: Superior angle of scapula
21*b*: Angulus inferior scapulae
22: Humerus
23: Rotator cuff
24*a*: Upper trapezius muscle
24*b*: Middle trapezius muscle
24*c*: Lower trapezius muscle
25: Occipital bone
26: Thoracic
27: Clavicle
28: Deltoid muscle
X: Elongation (%)
Y: Stretching stress (gf/cm [980 dyn/cm])
A: Body length direction
B: Chest width direction

DETAILED DESCRIPTION

Our clothing will now be described in detail with reference to the drawings.

Figure 2:
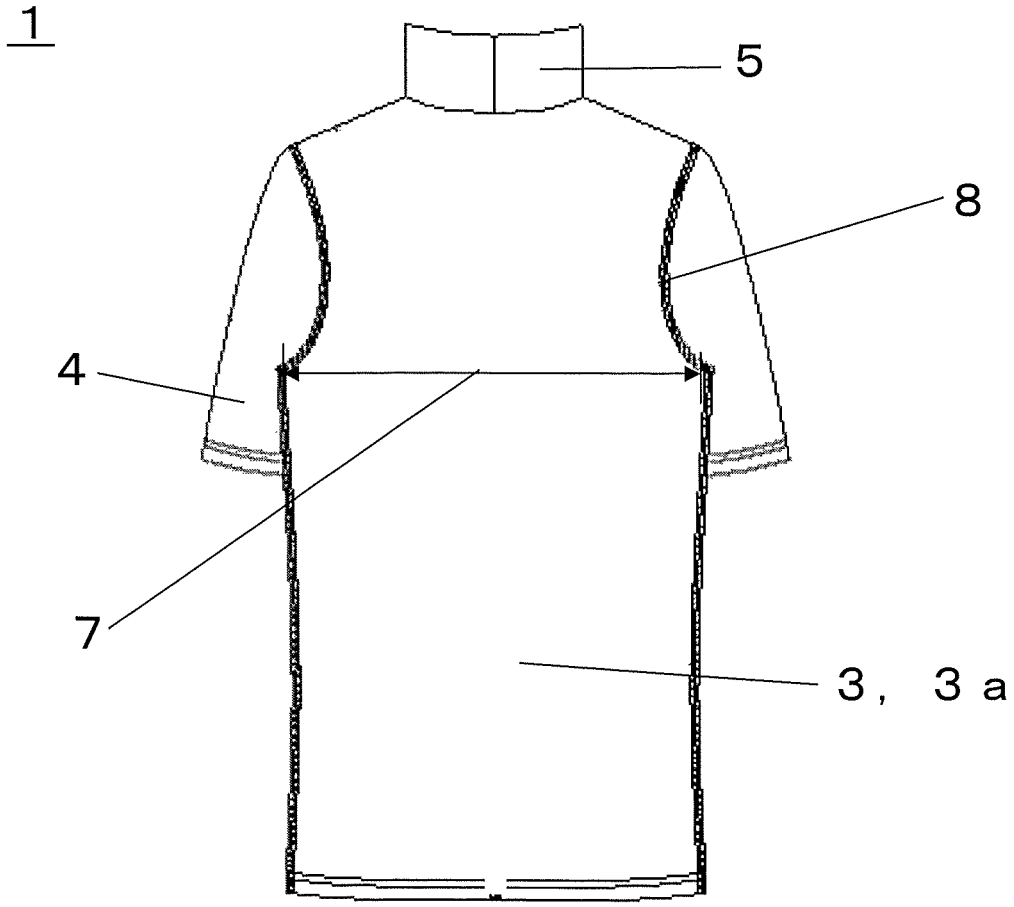
FIG. 2 is a rear view of our clothing.
Figure 3:
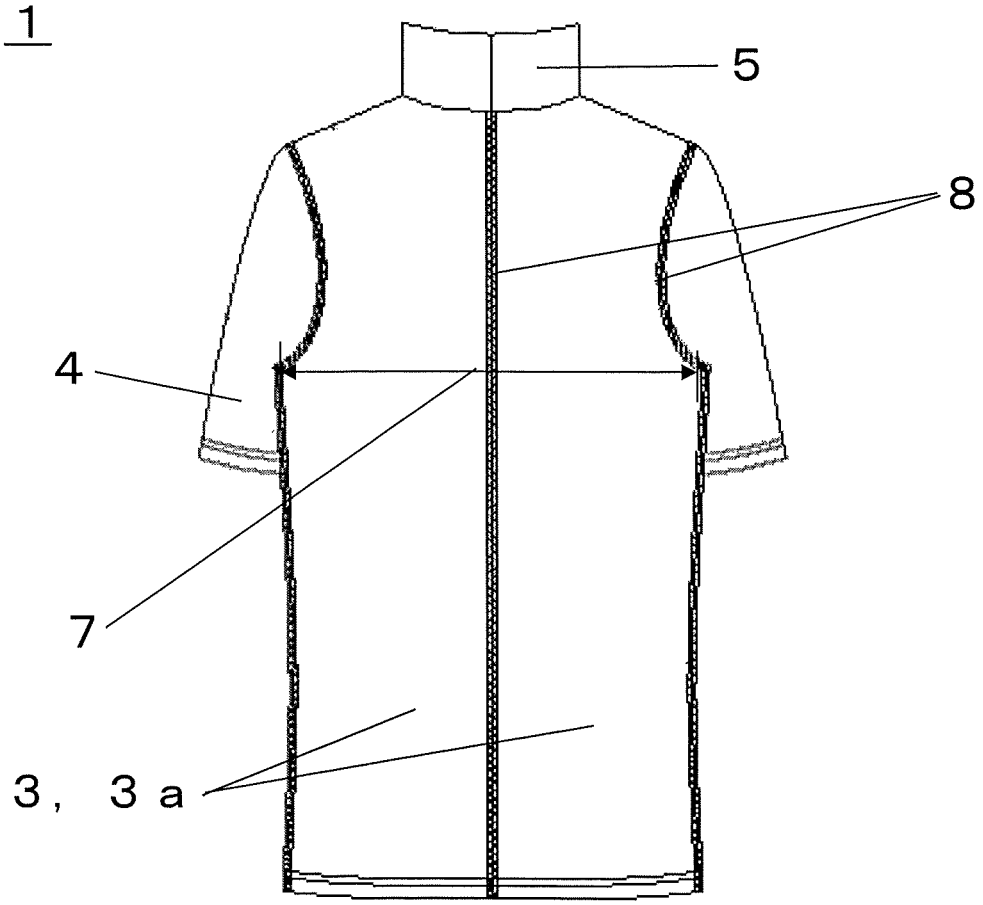
FIG. 3 is a rear view of our preferred clothing.
Figure 4:
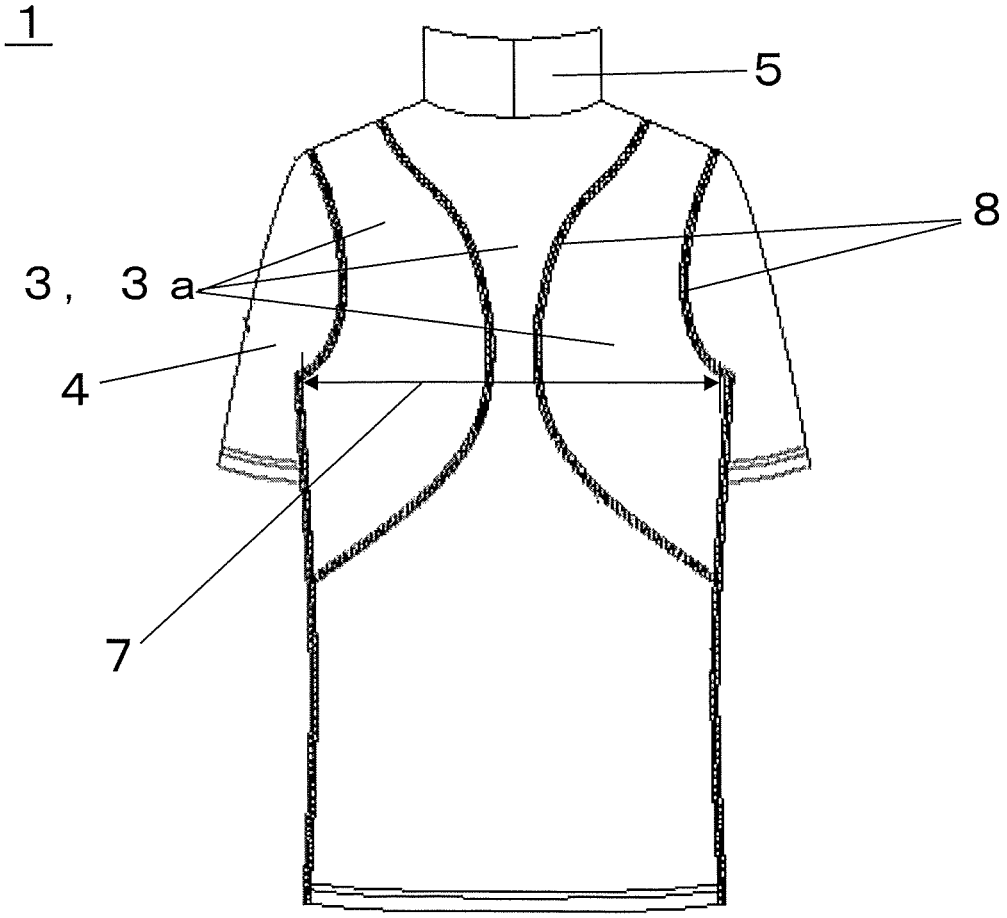
FIG. 4 is a rear view of further preferred clothing.

FIG. 1 shows an example of a front view of the clothing; FIG. 2 shows an example of a rear view of the clothing; and FIG. 3 and FIG. 4 show an example of a rear view of the clothing in a preferred aspect of our clothing. Clothing 1 is composed of at least two parts, a front body 2 and a back body 3. In the examples of FIGS. 1 to 4, the front body 2 and the back body 3 are each joined to a sleeve 4 and a neck 5 via a joint region 8, and, further, the front body 2 and the back body 3 are joined to each other via the joint region 8 to form an integral clothing 1. Symbol 6 denotes a chest width of the front body 2, and symbol 7 a chest width of the back body 3.

Figure 5:
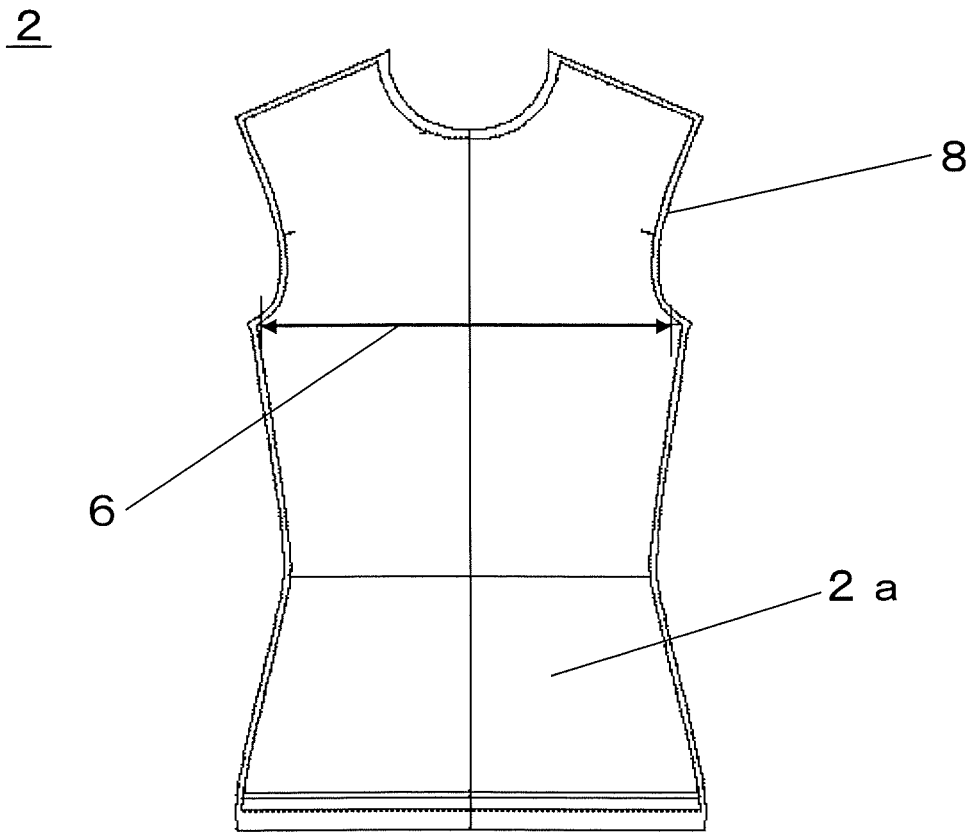
FIG. 5 is a developed view of a front body of the clothing shown in FIG. 1.

The front body 2 is composed of front body parts 2*a* as parts before assembling the clothing 1. An example of the front body parts 2*a* constituting a front body 2 of FIG. 1 is shown in FIG. 5.

Figure 6:
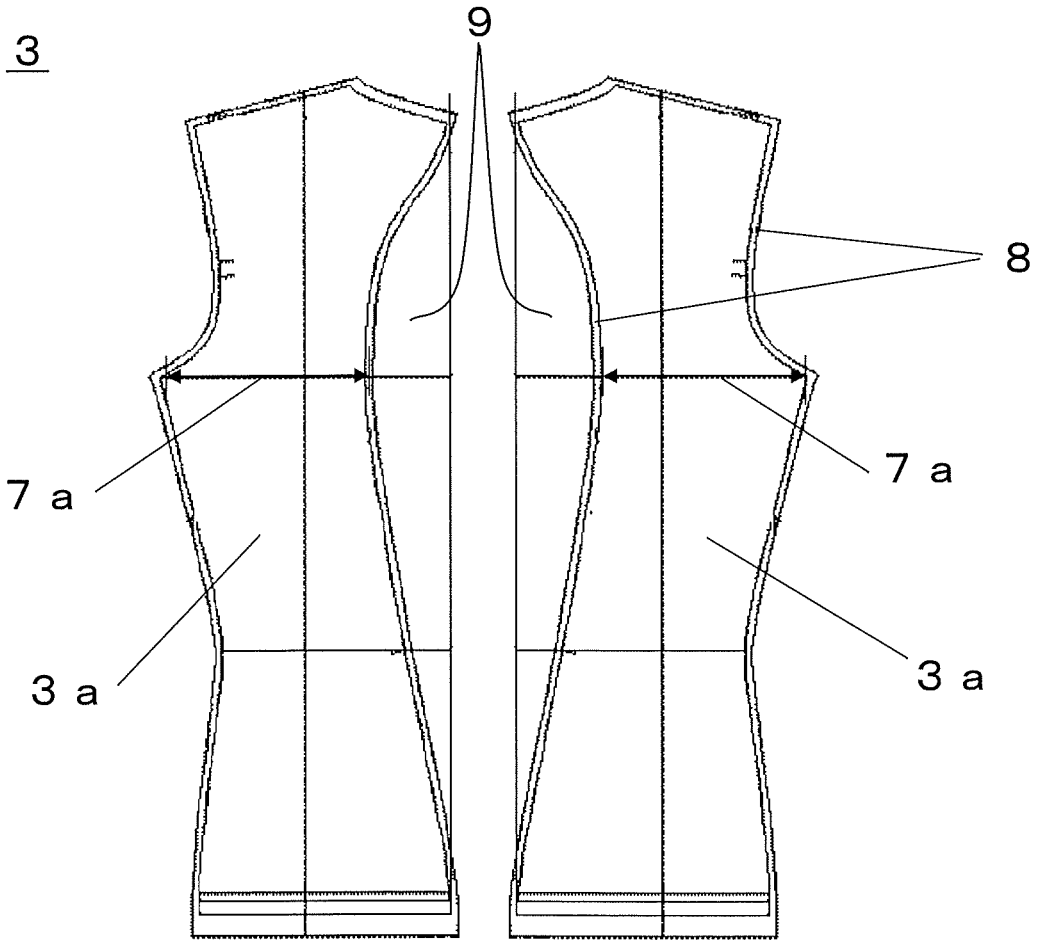
FIG. 6 is a developed view of a back body of the clothing shown in FIG. 3.

The back body 3 is composed of back body parts 3*a* as parts before assembling the clothing 1. An example of the back body parts 3*a* constituting the back body 3 of FIG. 3 is shown in FIG. 6, and an example of the back body parts 3*a* constituting the back body 3 of FIG. 4 in FIG. 7. In examples of FIG. 6 and FIG. 7, the back body parts 3*a* has a shape such that a cutting out portion 9 is formed when the back body parts 3*a* are arranged in the state before being joined. The cutting out portion 9 will be described in detail below. The sum of lengths 7*a* of portions corresponding to the chest width of each of the back body parts 3*a* is a chest width 7 of the back body 3 after being joined.

Figure 8:
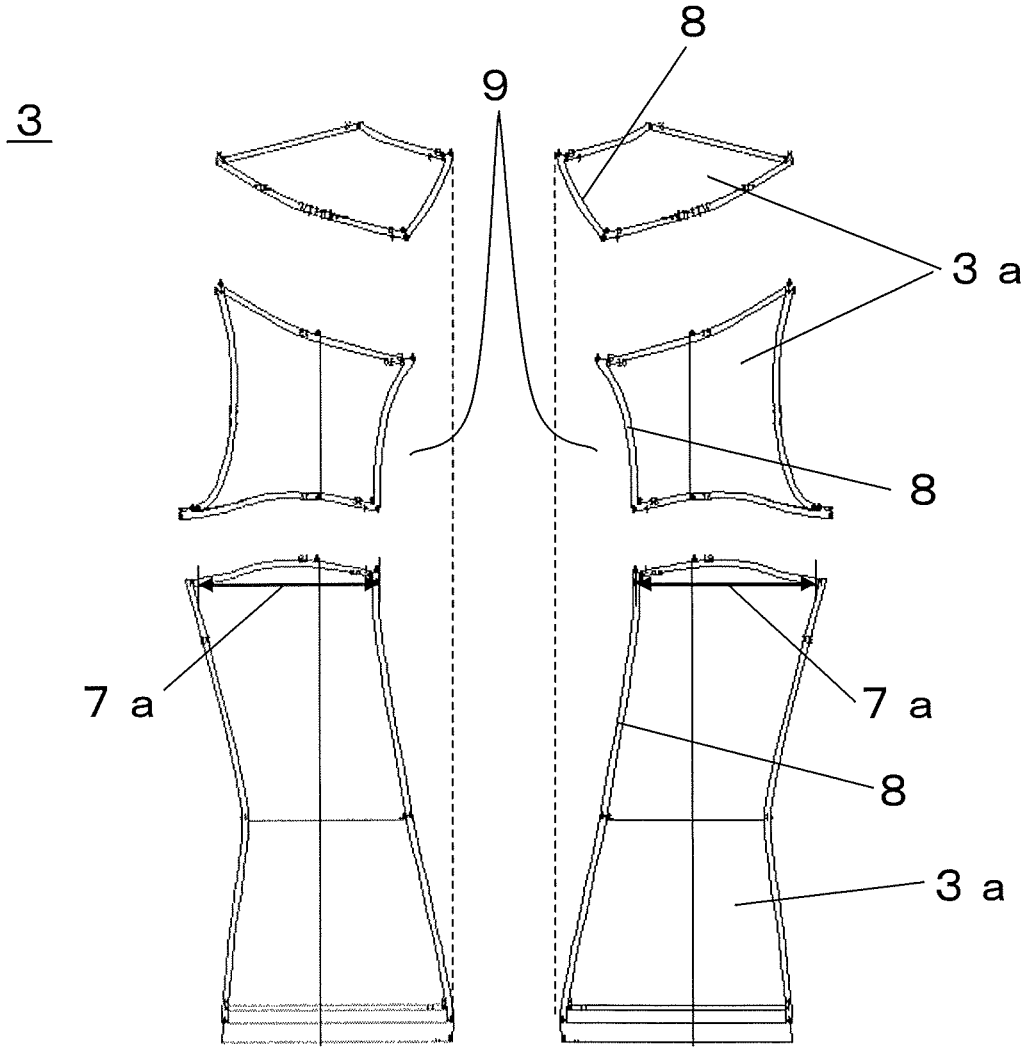
FIG. 8 is a developed view of a back body in another aspect.

The front body parts 2*a* and the back body parts 3*a* may be divided into smaller parts. An example of the back body parts 3*a* of FIG. 6 divided into smaller parts is shown in FIG. 8.

Figure 9:
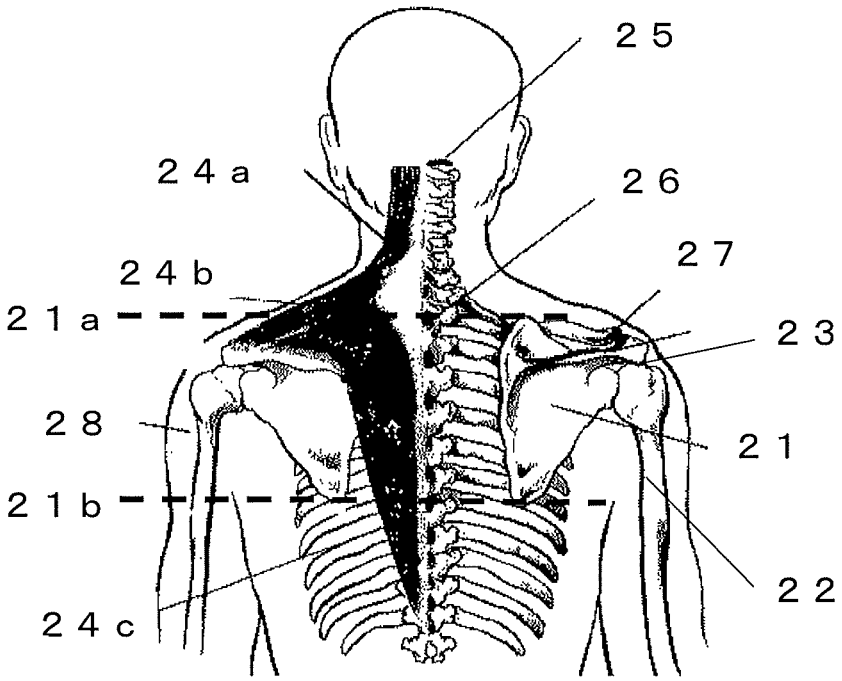
FIG. 9 is a musculoskeletal view from the back of a human body.

The musculoskeletal structure from the neck to around the shoulders of a human body is a structure as shown in FIG. 9. Starting from a scapula 21 and a humerus 22, a rotator cuff 23 is connected to the scapula 21, the scapula 21 to a trapezius muscle 24, the trapezius muscle 24 to a latissimus dorsi muscle, and the latissimus dorsi muscle to a pelvis. They are configured to pull each other to make a body motion.

The scapulae 21 are configured to move in three dimensions, i.e., up, down, left, right, back, and forth in six directions. A superior angle 21*a* is located at the upper end in the body length direction, and an angulus inferior 21*b* at the lower end. Procurvation tendency in posture such as stoop is the state of anterior inclination of scapulae.

The trapezius muscle 24 lies in a region between the left and right scapulae 21, and the muscular strength of the trapezius muscle 24 is related to a tensile load by which the scapulae 21 are drawn inward. We believe that when the muscular strength of the trapezius muscle 24 is weak (weakened), the scapulae 21 move outward away from each other and it is known that, in particular, the scapulae 21 of females are likely to move away from each other compared to those of males because the muscular strength of the trapezius muscle 24 to draw the scapulae 21 is weak.

Our clothing, when worn, applies a stretching stress to a human body toward the center of the back between left and right scapulae to thereby support the muscular strength of a trapezius muscle, and guides the left and right scapulae toward the center of the back to thereby bring a standing posture close to a vertical state or guide it to a chest sticking posture, promoting improvement in posture and reducing the tension of the trapezius muscle.

In our clothing, the front body 2 and the back body 3 are made of the same material. The clothing has a structure as mentioned below, and thus is capable of guiding left and right scapulae toward the center of the back when worn even if the front body 2 and the back body 3 are not made of different materials. Since the material of the front body 2 and the material of the back body 3 can be the same, a step of combining a plurality of materials can be omitted in manufacturing the clothing. Further, a fabric producing step and a sewing step can be shortened to improve productivity.

For the material of the components constituting the clothing, fiber fabrics/knits using a synthetic fiber or a natural fiber are preferred because of their high versatility. The type of synthetic fiber and natural fiber is not critical, but in view of washing resistance and versatility of original yarn and knitting/weaving design, it is preferable to use polyester, nylon fiber, or the like alone and in combination with polyurethane, rayon, acryl, cotton fiber, and the like.

For knitting/weaving design, either woven fabrics or knitted fabrics may be used, and more preferably, knitted fabrics are suitable because they have high elongation properties and can provide a sweat-absorbent/quick-drying function due to their texture structure. For knit texture, either warp knitting or weft knitting may be used, and more preferably, weft knitting is suitable which has relatively high elongation properties in the circumferential direction of a human body, i.e., the transverse direction, which is a tightening direction of a clothing.

The clothing is configured such that the chest width 7 of the back body 3 is shorter than the chest width 6 of the front body 2. Such a structure makes it possible to move the left and right scapulae of a human body toward the central part of the back in the rear to approach the relationship between the width across chest and the width across back in a drawn posture (width across chest>width across back), whereby the posture in which the left and right scapulae of a human body are drawn toward the central part of the back in the rear is easy to reconstruct when the clothing 1 is worn, and also in clothing appearance, a good silhouette following the contour of a human body can be achieved. When the chest width 7 of the back body 3 is longer than the chest width 6 of the front body 2, the relationship between the width across chest and the width across back in a forward-leaning posture of a body (width across chest<width across back) is approached, whereby the desired posture in which the left and right scapulae of a human body is drawn toward the central part of the back in the rear cannot be reconstructed, and in addition, the clothing appearance is likely to be a forward-leaning posture, i.e., a stoop-like silhouette.

Further, since the clothing is configured such that the chest width 7 of the back body 3 is shorter than the chest width 6 of the front body 2, an elongation 2(%) expressed by the following equation is greater than an elongation 1(%), and as a result, a stretching stress for guiding scapulae toward the center of the back is provided:

Elongation 1(%)={(intermediate value in chest or bust measurement range of a specific clothing size specified in a specific clothing standard/2)−chest width 6 of front body 2}/chest width 6 of front body 2×100

Elongation 2(%)={(intermediate value in chest or bust measurement range of a specific clothing size specified in a specific clothing standard/2)−chest width 7 of back body 3}/chest width 7 of back body 3×100.

"A specific clothing size specified in a specific clothing standard" is a clothing standard and a clothing size used as a standard in designing the clothing.

Examples of clothing standards include JIS L 4002 (1997) and JIS L 4003 (1997) "Sizing systems for boys' (girls') clothing," JIS L 4004 (2001) and JIS L 4005 (2001) "Sizing systems for women's (men's) clothing," JIS L 4006 (1998) "Sizing systems for foundation clothing," and JASPO standard sizing systems (for men, women, and junior) specified by Association of Japan Sporting Goods Industries (JASPO). The clothing size may be indicated by any indicating method such as designation by body type, designation by single numerical value, and designation by range. For example, in the case where the clothing is designed based on size M of the designation by range in JIS L 4004 (2001) "Sizing systems for men's clothing," the chest measurement range of the standard is 88 to 96 cm, and therefore "intermediate value in chest or bust measurement range of a specific clothing size specified in a specific clothing standard" is 92 cm.

The elongation 1 is a value simulatively determined using a difference between the pattern chest width measurement of the front body 2 constituting the clothing 1 and a human body measurement to represent how much the material constituting the front body 2 is elongated in the chest width direction when the clothing is worn.

The elongation 2 is a value simulatively determined using a difference between the pattern chest width measurement of the back body 3 constituting the clothing 1 and a human body measurement to represent how much the material constituting the back body 3 is elongated in the chest width direction when the clothing is worn. When the back body 3 is composed of a plurality of the back body parts 3*a*, the sum of chest widths 7*a* of each of the back body parts 3*a* is used as the chest width 7 of the back body 3 in the equation above.

A stretching stress 2 in the chest width direction at the elongation 2 of the material constituting the back body 3 is preferably greater than a stretching stress 1 in the chest width direction at the elongation 1 of the material constituting the front body 2.

Figure 11:
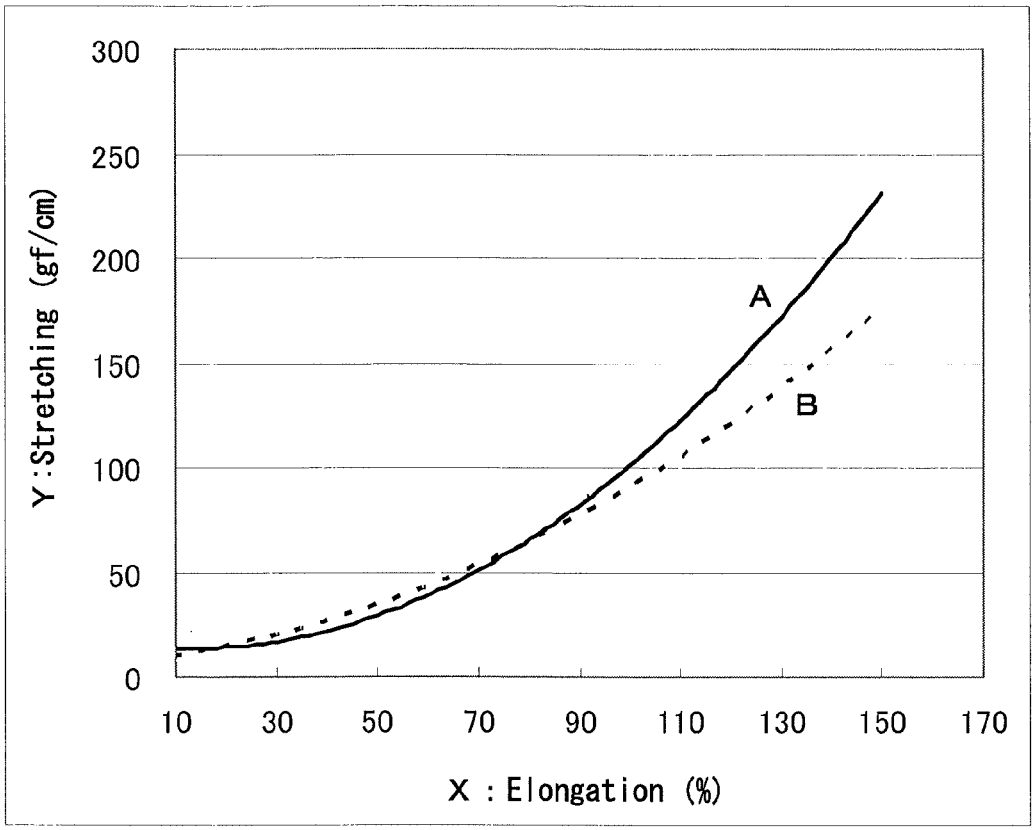
FIG. 11 is an example of an elongation/stretching stress curve of a material constituting the clothing.

The stretching stress at the elongations 1 and 2 is a value of a stretching stress at each point of the elongations 1 and 2, which is determined using an independently determined elongation-load curve in the chest width direction of the materials as shown in FIG. 11.

The stretching stress 1 in the chest width direction at the elongation 1 is a value that represents a stretching stress in the chest width direction of the front body applied when the clothing 1 is worn, and the stretching stress 2 at the elongation 2 is a value that represents a stretching stress in the chest width direction of the back body 3 applied when the clothing 1 is worn, the values being simulatively determined from the elongations 1 and 2 and the elongation-load curve of the materials.

In general, the elongation and stretching stress of a clothing material are in proportion to each other, and the stretching stress increases as the elongation increases. The front body 2 and the back body 3 are made of the same material and, since the chest width 7 of the back body 3 is shorter than the chest width 6 of the front body 2, the elongation 2 is greater than the elongation 1. Thus, the stretching stress 2 is necessarily greater than the stretching stress 1. Namely, when the clothing 1 is worn, the stretching stress applied in the chest width direction of the back body 3 is greater than the stretching stress applied in the chest width direction of the front body 2, and the stretching stress of the material can be focused toward the center of the back between left and right scapulae.

If the chest width 7 of the back body 3 is longer than the chest width 6 of the front body 2, the elongation 2 is smaller than the elongation 1, and thus the stretching stress 2 is smaller than the stretching stress 1. As a result, when the clothing 1 is worn, the stretching stress applied in the chest width direction of the back body 3 is smaller than the stretching stress applied in the chest width direction of the front body 2, and the stretching stress of the material is dispersed in the forward direction, thus failing to produce the desired effect of focusing the stretching stress of the material toward the center of the back between left and right scapulae.

The elongation and stretching stress applied in the chest width direction of the back body 3 when the clothing 1 is worn is higher than the elongation and the stretching stress applied in the chest width direction of the front body 2, whereby when the clothing 1 is worn, the stretching stress of the material can be focused between the left and right scapulae to bring a standing posture close to a vertical state or guide it to a chest sticking posture.

The ratio of the chest width 6 of the front body 2 to the chest width 7 of the back body 3 (the chest width 6 of the front body 2/the chest width 7 of back body 3) is preferably 1.1 or more, more preferably in the range of 1.1 to 1.6. When the ratio is 1.1 or more, left and right scapulae of a human body can be moved toward the central part of the back in the rear to approach the ratio of the width across chest to the width across back (width across chest/width across back) in a drawn posture, whereby the posture in which left and right scapulae of a human body are drawn toward the central part of the back in the rear is easy to reconstruct when the clothing 1 is worn.

Although the clothing design for making the chest width 7 of the back body 3 shorter than the chest width 6 of the front body 2 is not critical, when the back body parts 3*a* constituting the back body 3 is arranged in a plane without being joined, there is preferably a part where a portion of the material is cut out, i.e., the cutting out portion 9, regardless of a human body shape or a human body measurement. Namely, when the back body parts 3*a* are arranged in a plane without being joined, the back body parts 3*a* that form the cutting out portion 9 forms a part where a portion of a fabric is cut out of the back body 3 as if the part corresponds to a human body shape or a human body measurement. The cutting out portion 9 is integrally closed by the joint region 8, and the final back body 3 has an appearance without an opening resulting from the cutting out portion 9. The measurement of the chest width 7 of the final back body 3 is shorter than the chest width measurement of a human body by a length corresponding to the closed cutting out portion 9. Further, if the chest width of the back body parts 3*a* arranged in a plane without being joined (including the width of the cutting out portion) is the same as the chest width 7 of the front body 2, the measurement of the chest width 7 of the final back body 3 can be shorter than the chest width 6 of the front body 2 by a length corresponding to the closed cutting out portion 9.

In general, in sewing of a clothing, techniques such as darts and tucks may be used to give a three-dimensional appearance when the clothing is worn or locally reduce the measurement, but these are contemplated to follow the contour of a human body and designed such that the finished measurement of the clothing has some ease relative to a human body measurement, both of which being different from the cutting out portion 9.

By providing the cutting out portion 9 at a site where a great stretching stress should be locally applied when the clothing is worn, a great measurement difference is caused between the finished measurement of the site and a human body measurement, and the site of the clothing is expanded by a human body when the clothing is worn, whereby an elongation and load of the material can be produced.

In general, when it is desired to locally apply a great stretching stress to the clothing 1, a method in which a material having a different elongation and stretching stress is used for the site of interest or a method in which the texture and yarns of the site is varied is used. By using a method in which the cutting out portion 9 is formed, different elongations and loads can be achieved with a single material without varying the texture or yarns.

One example of the cutting out portion 9 is shown in FIG. 6. In the example of FIG. 6, the cutting out portion 9 is formed around the central part of the chest width 7 of the back body 3. The back body 3 is composed of a plurality of the back body parts 3*a*, and the sum of the chest widths 7*a* of each of the back body parts 3*a* is shorter than a human body measurement. Further, the cutting out portion 9 is formed in a curve around the central part of the chest width such that the difference between the sum of the chest widths 7*a* and the human body measurement is maximum at the central part of the chest width.

Figure 7:
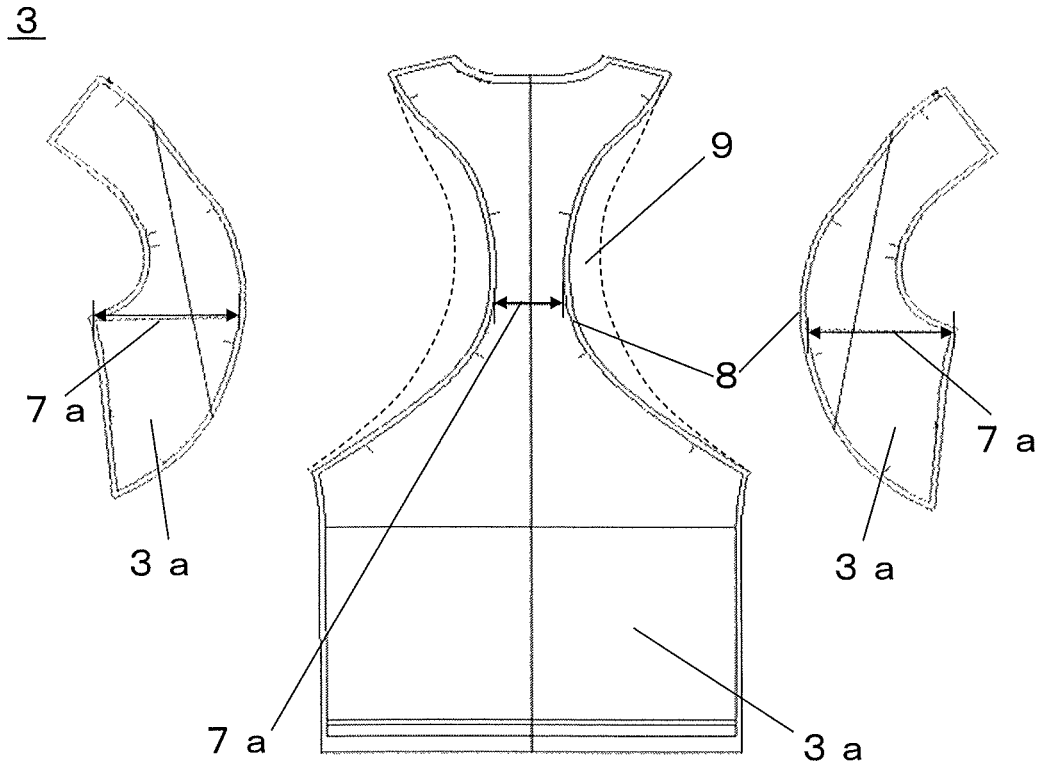
FIG. 7 is a developed view of a back body of the clothing shown in FIG. 4.

Another example of the cutting out portion 9 shown in FIG. 7. In the example of FIG. 7, the cutting out portion 9 is formed around the left and right scapulae of the back body 3. The back body 3 is composed of a plurality of the back body parts 3*a*, and the sum of the chest widths 7*a* of the back body parts 3*a* is shorter than a human body measurement. Further, the cutting out portion 9 is formed in a curve around the left and right scapulae such that the difference between the sum of the chest widths 7*a* and the human body measurement is maximum at the central part of the chest width.

For the cutting out portion 9, when the back body parts 3*a* are joined, the joint region of the cutting out portion 9 is preferably formed such that it passes between left and right scapulae of a human body. By forming the cutting out portion 9 at such a position, when the clothing 1 is worn, a great stretching stress for guiding left and right scapulae of a human body toward the central part of the back in the rear is applied, and a standing posture can be brought close to a vertical state or guided to a chest sticking posture.

Further, the cutting out portion 9, when the back body parts 3*a* are joined, preferably has a length such that the joint region of the cutting out portion 9 lies from superior angle of scapula to angulus inferior scapulae. Such a length covers the range of motion of scapulae, and a stretching stress for guiding left and right scapulae toward the central part of the back in the rear can be efficiently provided when the clothing 1 is worn, promoting improvement in posture.

Besides formation of the cutting out portion 9, there are methods for making the chest width 7 of the back body 3 shorter than a human body measurement or shorter than the chest width 6 of the front body 2. Examples thereof include reducing the measurement of the whole back body 3 in the width direction and reducing the measurement of the chest width 7 by shifting both left and right positions of the upper end of a side line and the lower end of an armhole inwardly in the direction of the chest width 7. Any of these methods may be used, but formation of the cutting out portion 9 is particularly preferred.

In forming the cutting out portion 9, since the positions of the upper end of a side line and the lower end of an armhole are not changed, there is no need to change the shape of the joint region of the sleeve for joining with the back body 3, and thus, wearing comfort and motion followability are not impaired. Still further, the stretching stress can be freely adjusted only by changing the size of the cutting out portion 9, which leads to high versatility in specification. Further, since the stretching stress is focused on the cutting out portion 9, it is easy to enhance a scapula-drawing effect, for example, by disposing the cutting out portion 9 at the center of the back between left and right scapulae, which leads to high posture improvability.

The clothing may include the sleeve 4, the neck 5, pockets, and the like in addition to the front body 2 and the back body 3.

The clothing has the joint region 8 for joining parts in assembling the clothing. Means for joining the parts at the joint region 8 may be any of sewing with a sewing machine, adhesion with tape, welding, and the like. Among them, sewing with a sewing machine is preferred because of its excellent balance between strength and productivity. The joint region 8 is preferably formed in a planar shape with no exposed fabric edge because contact with skin can be reduced.

The stretching stress 1 at the elongation 1 as determined by the above equation is preferably in the range of 1 to 30 gf/cm (980 to 29,400 dyn/cm), and the stretching stress 2 at the elongation 2 is preferably in the range of 20 to 100 gf/cm (19,600 to 98,000 dyn/cm).

When the stretching stress is 1 gf/cm (980 dyn/cm) or more, a sufficient stretching stress is applied to the front body 2, and the stretching stress is not unevenly applied only to the back body 3, thus not causing unpleasantness or discomfort when the clothing is worn. When the stretching stress 1 is 30 gf/cm (29,400 dyn/cm) or less, the sense of pressure at the front body 2 is not too strong, thus not causing discomfort at the breast or the like. The stretching stress 1 is more preferably in the range 5 to 20 gf/cm (4,900 to 19,600 dyn/cm).

When the stretching stress 2 is 20 gf/cm (19,600 dyn/cm) or more, a sufficient stretching stress is applied to the region between left and right scapulae of the back body 3, and thus it is easy to bring a standing posture close to a vertical state or guide it to a chest sticking posture. When the stretching stress 2 is 100 gf/cm (98,000 dyn/cm) or less, the force of guiding left and right scapulae to the center of the back is in an appropriate range, thus not impeding normal body motions such as forward-leaning posture or causing discomfort due to pressure. The stretching stress 2 is more preferably 20 to 60 gf/cm (19,600 to 58,800 dyn/cm).

A stretching stress 1 of 1 to 30 gf/cm (980 to 29,400 dyn/cm) and a stretching stress 2 of 20 to 100 gf/cm (19,600 to 98,000 dyn/cm) provide excellent wearing comfort and make it easy to bring a standing posture close to a vertical state or guide it to a chest sticking posture.

The materials constituting the front body 2 and the back body 3 preferably have an elongation 3 in the chest width direction at 14.7 N elongation of 70% or more because the clothing is able to follow skin extension on human body motion, thus not hindering motions and providing ease of putting on and taking off. The elongation 3 as used herein is a value determined by actually measuring the magnitude of elongation of the material used as its physical properties regardless of the shape and measurement of the clothing, and is different from the elongation 1 and the elongation 2 mentioned above which are values of the magnitude of elongation of the front body 2 and the back body 3 determined from simple equations on the assumption that the clothing 1 is worn.

The elongation 3 is measured according to JIS L 1096 (2010) "Testing methods for woven and knitted fabrics." Using a constant-rate-extension tester specified in this JIS standard, the materials constituting the front body 2 and the back body 3 are elongated at a chuck distance of 20 cm and a tensile speed of 20 cm/min to a tensile load 14.7 N, when the elongation is measured.

It is more preferred that the materials constituting the front body 2 and the back body 3 have an elongation at 14.7 N elongation of 70% or more in both the clothing body length direction and the chest width direction, and it is preferred that at least the value belonging to the circumferential direction in which a human body is tightened, i.e., the elongation in the chest width direction be 70% or more.

Further, the materials constituting the front body 2 and the back body 3 are repeatedly subjected to tensile elongation when used or worn, and thus the elastic recovery of elongation measured when the stretching stress is released after 14.7 N elongation is preferably in the range of 85 to 100% because the clothing undergoes less deformation and measurement change before and after wearing and withstands repeated use, not leading to significantly different wear comfort.

The elastic recovery of elongation is measured according to JIS L 1096 (2010) B-1 method (constant load method). A value measured after 30 seconds from load release is used as a length between marks after unloading.

The elastic recovery of elongation is more preferably 90 to 100%.

When the materials constituting the front body 2 and the back body 3 has an elongation 3 and elastic recovery properties following skin extension, motion followability and dimensional stability can be provided.

The ratio of the value of the elongation 3 in the chest width direction to the value of the elongation 3 in the body length direction at 14.7 N elongation (elongation 3 in chest width direction/elongation 3 in body length direction) of the materials constituting the front body 2 and the back body 3 is preferably in the range of 0.5 to 2.0. When the ratio of the value of the elongation 3 in the chest width direction to the value of the elongation 3 in the body length direction is in this range, the clothing 1 elongates in the body length direction and the chest width direction in good balance relative to the skin extension in the body length direction and the chest width direction of a human body upon motion of a wearer of the clothing 1, and has excellent motion followability.

The ratio of the elongation 3 in the chest width direction to the elongation 3 in the body length direction is more preferably in the range of 0.8 to 1.2. By approximating the value of the elongation 3 in the body length direction and the value of the elongation 3 in the width direction of the materials constituting the front body 2 and the back body 3 to balance the elongations in both direction, improved motion followability is provided when the clothing 1 is worn.

The total measurement of the chest width 6 of the front body 2 and the chest width 7 of the back body 3 is preferably lower than the lower limit of a chest or bust measurement range of a specific clothing size specified in a specific clothing standard. "A specific clothing size specified in a specific clothing standard" is a clothing standard and a clothing size used as a standard in designing the clothing. The clothing is configured such that the chest width 7 of the back body 3 is shorter than the chest width 6 of the front body 2, and therefore the total measurement of the chest width 6 of the front body 2 and the chest width 7 of the back body 3 is shorter than that of a conventional clothing, whereby a stretching stress for guiding scapulae toward the center of the back is provided. Further, by making the total measurement of the chest width 6 of the front body 2 and the chest width 7 of the back body 3 lower than the lower limit of a chest or bust measurement range of a specific clothing size specified in a specific clothing standard, the stretching stress for guiding scapulae toward the center of the back can be further enhanced.

The various standards mentioned above can be applied as a clothing standard. For example, when the clothing is designed based on size M of the designation by range in JIS L 4004 (2001) "Sizing systems for men's clothing," the chest measurement range of the standard is 88 to 96 cm, and therefore "the lower limit of a chest or bust measurement range of a specific clothing size specified in a specific clothing standard" is 88 cm.

The clothing may be of type what is called sleeveless or tank top where the shape of the clothing 1 is without the sleeve 4. When the clothing has the sleeve 4, the specification of the sleeve 4 may be a raglan specification or set-in specification. Alternatively, the clothing may be of what is called half shape where the front body and the back body of the clothing 1 cover the breast and the area around scapulae of a human body but do not cover the abdomen and the lower back.

The clothing 1 is suitably used mainly for underwear, foundation, innerwear with cups, cut and sewn, and jackets.

EXAMPLES

Our clothing and methods will now be described in more detail with reference to examples, but this disclosure is not limited thereto.

The clothing used in the Examples and Comparative Examples was evaluated for posture improvability, motion followability, and wearing comfort by a user test of 10 subjects. The criteria for evaluation is shown in Table 1. The total score of evaluation scores of all the subjects is a result of evaluation of each property, and the total score of the results of evaluation of each property is a total evaluation. When the total evaluation is 15 or more, the clothing is evaluated as good, and higher scores indicate higher properties.

Measurements

Elongation 1, 2

Elongations 1 and 2 were determined by the following equations from the relationship between the chest width measurements of the front body and the back body of a clothing manufactured and a clothing standard and a clothing size used as a standard in designing the clothing. The intermediate value in the range of designation by range was used as a chest or bust measurement of each size.

Elongation 1(%)={(intermediate value in chest or bust measurement range of a specific clothing size specified in a specific clothing standard/2)−chest width of front body}/chest width of front body×100

Elongation 2(%)={(intermediate value in chest or bust measurement range of a specific clothing size specified in a specific clothing standard/2)−chest width of back body}/chest width of back body×100

"A specific clothing size specified in a specific clothing standard" is a clothing standard and a clothing size used as a standard in designing the clothing.

Stretching stress 1, 2

Measurements were made according to JIS L 1096 (2010) "Testing methods for woven and knitted fabrics." Using a constant-rate-extension tester specified in this JIS standard, the materials constituting the front body and the back body were elongated in the chest width direction under conditions of a chuck distance of 20 cm and a tensile speed of 20 cm/min. The stretching stress at the elongation 1 was defined as a stretching stress 1, and the stretching stress at the elongation 2 as a stretching stress 2.

Elongation 3

Measurements were made according to JIS L 1096 (2010) "Testing methods for woven and knitted fabrics." Using a constant-rate-extension tester specified in this JIS standard, the materials constituting the front body and the back body were elongated at a chuck distance of 20 cm and a tensile speed of 20 cm/min to a tensile load of 14.7 N (1.5 Kgf), when the elongations in the body length direction and in the chest width direction were each measured.

Ratio of Elongation 3

From the values of the elongation 3 in the body length direction and the chest width direction of the materials constituting the front body and the back body, the ratio of the elongation 3 was determined by the following equation:

Ratio of elongations 3=elongation 3 in chest width direction/elongation 3 in body length direction.

Elastic Recovery of Elongation

Measurements were made according to JIS L 1096 (2010) B-1 method (constant load method). For the materials constituting the front body and the back body, (1) a length between original marks, (2) a length between marks after applying a load of 14.7 N (1.5 kgf) and holding for 1 hour, and (3) a length between marks after 30 seconds from unloading were measured each in the body length direction and the chest width direction to determine their elastic recovery.

Rate of Change in Distance Between Angulus Inside Scapulae Point

Figure 10:
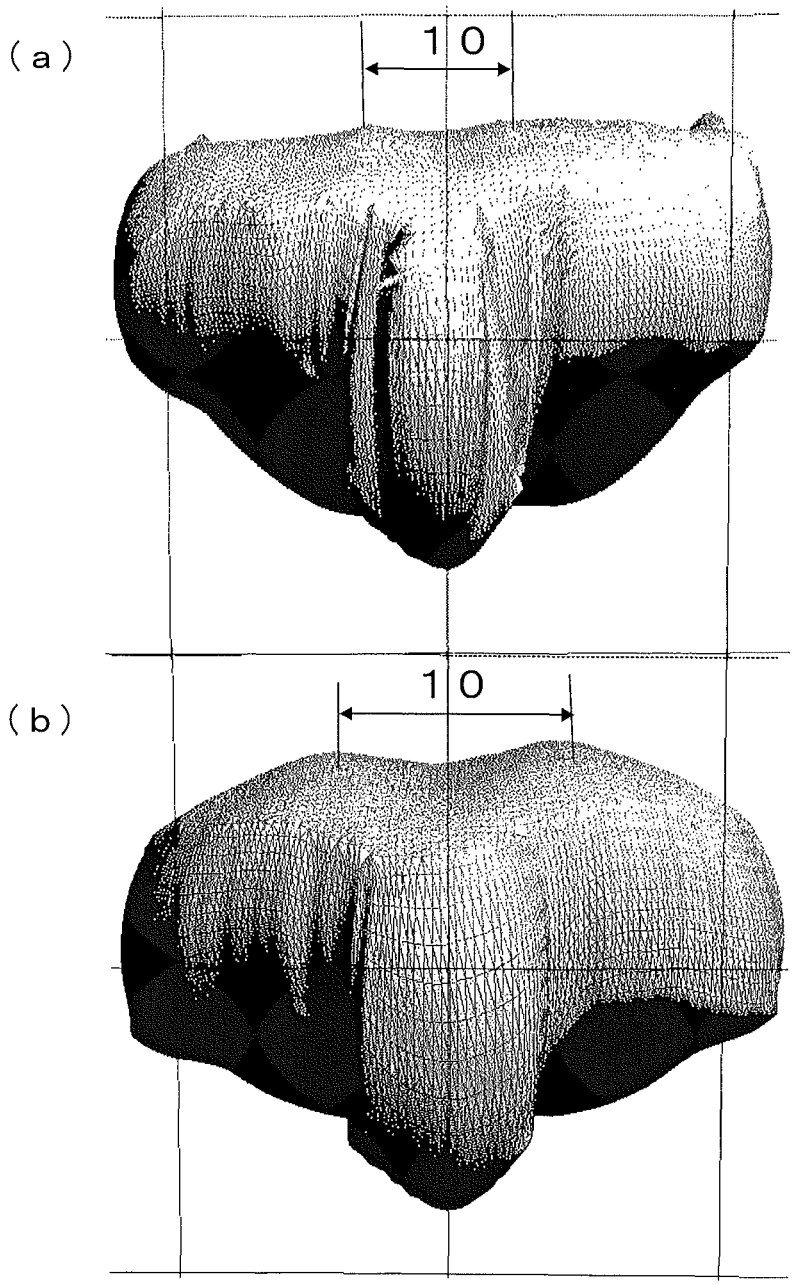
FIG. 10 is (a) a top view of a human body wearing our clothing, and (b) a top view of a human body not wearing our clothing.

As shown in FIGS. 10 (*a*) and (*b*), the distance between the angulus inside scapulae point 10 in a standing posture before and after wearing the clothing 1 was measured using a three-dimensional meter available from SUN ENGINEERING Co., Ltd., and the rate of change before and after wearing was determined by the following equation:

Rate of change (%)=(distance between angulus inside scapulae point 10 after wearing−distance between angulus inside scapulae point 10 before wearing)/distance between angulus inside scapulae point 10 before wearing×100.

The average value of measurements of 10 subjects of the same clothing size was used as an evaluation result, and rates of −5% or less were evaluated as good.

Evaluation

Posture Improvability

For 10 subjects of the same clothing size wearing the clothing 1, posture improvability in a standing posture, i.e., the presence of a sense of left and right scapulae being guided toward the center of the back was evaluated on a 4-point scale. Higher evaluation scores indicate higher posture improvability. The total evaluation score of the 10 test users were used as an evaluation result, and when the total evaluation score was 5 or higher, the clothing was evaluated as good. The criteria for evaluation is shown in Table 1.

Motion Followability

For 10 subjects of the same clothing size wearing the clothing 1, followability of the clothing upon forward bending motion with arms hung down was evaluated on a 4-point scale. Higher evaluation scores indicate higher motion followability. The total evaluation score of the 10 test users were used as an evaluation result, and when the total evaluation score was 5 or higher, the clothing was evaluated as good. The criteria for evaluation is shown in Table 1.

Wearing Comfort

For 10 subjects of the same clothing size wearing the clothing 1, comfort against wear pressure and oppression in a standing posture was evaluated on a 4-point scale. Higher evaluation scores indicate higher wearing comfort. The total evaluation score of the 10 test users were used as an evaluation result, and when the total evaluation score was 5 or higher, the clothing was evaluated as good. The criteria for evaluation is shown in Table 1.

TABLE 1

| Scores | Posture Improvability | Motion Followability | Wearing Comfort |
|---|---|---|---|
| 2 | greatly improved | excellent | very comfortable |
| 1 | improved | good | comfortable |
| −1 | no change | bad | tight |
| −2 | worsened | worse | very tight |

In all Examples and Comparative Examples, the clothing was designed based on size M of the designation by range specified in JIS L 4004 (2001) "Sizing systems for men's clothing."

Example 1

Using the front body parts 2*a* of FIG. 5 and the back body parts 3*a* of FIG. 6, the clothing 1 represented by the front view of FIG. 1 and the rear view of FIG. 3 was manufactured. An interknitted plain knit fabric comprising 88% of polyester and 12% of polyurethane was manufactured as a material of the clothing 1. For the material obtained, the elongations 3 in the body length direction and the chest width direction were 120% and 150%, respectively; the elastic recovery of elongation in the body length direction and the chest width direction were 91% and 93%, respectively; and the ratio of the elongations 3 was 1.25. Next, patterns of the front body parts 2*a*, the back body parts 3*a*, the sleeve 4, and the neck 5 of size M for men were prepared and marked such that the body length direction of the material was the body length direction of each part and the sleeve 4, and cutting was carried out.

The front body 2, as shown in FIG. 5, was composed of the front body parts 2*a* of one piece. The measurement of the chest width 6 of the front body 2 was set at 39 cm so that the elongation 1 was 18% relative to 92 cm which is the intermediate value of the chest measurement range of size M (88 to 96 cm) according to the designation by range in JIS L 4004 (2001).

The back body 3, as shown in FIG. 6, was composed of the back body parts 3*a* of two pieces formed by being divided at the midpoint of the chest width into left and right two parts. The measurement of the chest width 7 of the back body 3 was set at 30 cm so that the elongation 2 was 53% relative to the intermediate value 92 cm of the chest measurement range of size M. 15 cm, half of 30 cm, was the measurement of the chest width 7*a* of each of the back body parts 3*a*. Based on the chest width measurement obtained, a line of the joint region 8 for joining the back body parts 3*a* of two pieces was then drawn to form one cutting out portion 9. The cutting out portion 9 is formed such that the joint region of the cutting out portion 9 lies at the center of left and right scapulae from the superior angle to the waist when the back body parts 3*a* are joined.

The front body parts 2*a*, the back body parts 3*a*, the sleeve 4, and the neck 5 obtained were joined by sewing at the joint region 8 as shown in FIG. 1 and FIG. 3 using a flat seamer sewing machine to form the clothing 1.

The clothing obtained was evaluated for posture improvability, motion followability, and wearing comfort according to the evaluation criteria in Table 1. The loads for stretching 1 and 2 of the clothing were 12 gf/cm (11,760 dyn/cm) and 40 gf/cm (39,200 dyn/cm), respectively. The ratio of the chest width 6 of the front body 2 to the chest width 7 of the back body 3 was 1.13, and the sum of the chest width 6 of the front body 2 and the chest width 7 of the back body 3 was 69 cm, which was below the lower limit (88 cm) of the chest measurement range in the JIS standard. Table 2 shows the measurements and evaluation results.

Example 2

Using the front body parts 2*a* of FIG. 5 and the back body parts 3*a* of FIG. 7, the clothing 1 represented by the front view of FIG. 1 and the rear view of FIG. 4 was manufactured. An interknitted plain knit fabric comprising 51% of cotton, 24% of acryl, 20% of rayon, and 5% of polyurethane was manufactured as a material of the clothing 1. For the material obtained, the elongations 3 in the body length direction and the width direction were 70% and 90%, respectively; the elastic recovery of elongation in the body length direction and the width direction were 80% and 86%, respectively; and the ratio of the elongations 3 was 1.28. Next, patterns of the front body parts 2*a*, the back body parts 3*a*, the sleeve 4, and the neck 5 of size M for men were prepared and marked such that the body length direction of the material was the body length direction of each part and the sleeve 4, and cutting was carried out.

The front body 2, as shown in FIG. 5, was composed of the front body parts 2*a* of one piece, and the measurement of the chest width 6 of the front body 2 was set at 33 cm so that the elongation 1 was 39% relative to 92 cm which is the intermediate value of the chest measurement range of size M (88 to 96 cm) according to the designation by range in JIS L 4004 (2001).

The back body 3, as shown in FIG. 7, was composed of the back body parts 3*a* of three pieces formed by being divided at positions corresponding to the interior vicinity of left and right scapulae into left, right, and central three parts, and the measurement of the chest width 7 of the back body 3 was set at 29 cm so that the elongation 2 was 59% relative to the intermediate value 92 cm of the chest measurement range of size M. The measurement of these three divided parts was the measurement of the chest width 7*a* of each of the back body parts 3*a*. Based on the chest width measurement obtained, a line of the joint region 8 for joining the back body parts 3*a* of three pieces was drawn to form the cutting out portion 9. The cutting out portion 9 is formed such that the joint region of the cutting out portion 9 lies between left and right scapulae substantially along the left and right scapulae from the superior angle to the angulus inferior when the back body parts 3*a* are joined.

The front body parts 2*a*, the back body parts 3*a*, the sleeve 4, and the neck 5 obtained were joined by sewing at the joint region 8 as shown in FIG. 1 and FIG. 4 using a flat seamer sewing machine to form the clothing 1.

The clothing obtained was evaluated for posture improvability, motion followability, and wearing comfort according to the evaluation criteria in Table 1. The loads for stretching 1 and 2 of the clothing were 32 gf/cm (31,360 dyn/cm) and 48 gf/cm (47,040 dyn/cm), respectively. The ratio of the chest width 6 of the front body 2 to the chest width 7 of the back body 3 was 1.13, and the sum of the chest width 6 of the front body 2 and the chest width 7 of the back body 3 was 62 cm, which was below the lower limit (88 cm) of the chest measurement range in the JIS standard. Table 2 shows the measurements and evaluation results.

Example 3

The clothing 1 represented by the front view of FIG. 1 and the rear view of FIG. 2 was manufactured. The back body 3 was composed of the back body parts 3*a* of one piece with no cutting out portion 9 formed.

For the back body parts 3*a*, the chest width 7 was adjusted to 30 cm, which was shorter than the chest width 6 of the front body 2, by shifting both left and right positions of the upper end of a side line and the lower end of an armhole inwardly in the direction of the chest width 7 compared to the front body parts 2*a*. Further, the sleeve seam length and the end position of the sleeve 4 were aligned to the armhole position. Except the above, the clothing 1 was formed in the same manner as in Example 1.

The clothing obtained was evaluated for posture improvability, motion followability, and wearing comfort according to the evaluation criteria in Table 1. The loads for stretching 1 and 2, the ratio of the chest width 6 of the front body 2 to the chest width 7 of the back body 3, and the sum of the chest width 6 of the front body 2 and the chest width 7 of the back body 3 of the clothing was 69 cm similarly to Example 1, which was below the lower limit (88 cm) of the chest measurement range in the JIS standard. Table 2 shows the measurements and evaluation results.

Comparative Example 1

The clothing 1 represented by the front view of FIG. 1 and the rear view of FIG. 2 was manufactured. The material of the clothing 1 was the same as the material of Example 1. The back body 3 was composed of the back body parts 3*a* of one piece having no cutting out portion 9.

Patterns of the front body parts 2*a*, the back body parts 3*a*, the sleeve 4, and the neck 5 of size M for men were prepared and marked such that the body length direction of the material was the body length direction of each part and the sleeve 4, and cutting was carried out.

The measurement of the chest width 6 of the front body 2 was set at 55 cm so that the elongation 1 was −16% relative to 92 cm which is the intermediate value of the chest measurement range of size M (88 to 96 cm) according to the designation by range in JIS L 4004 (2001). The measurement of the chest width 7 of the back body 3 was also set at 55 cm so that the elongation 2 was −16%. Namely, neither the front body 2 nor back body 6 elongates when the clothing 1 is worn.

The front body parts 2*a*, the back body parts 3*a*, the sleeve 4, and the neck 5 obtained were joined by sewing at the joint region 8 as shown in FIG. 1 and FIG. 2 using a flat seamer sewing machine to form the clothing 1.

The clothing obtained was evaluated for posture improvability, motion followability, and wearing comfort according to the evaluation criteria in Table 1. The loads for stretching 1 and 2 of the clothing were both 0 gf/cm (0 dyn/cm), which means that there were no stretching stress. The ratio of the chest width 6 of the front body 2 to the chest width 7 of the back body 3 was 1.0, and the sum of the chest width 6 of the front body and the chest width 7 of the back body 3 was 110 cm, which was above the upper limit (96 cm), to say nothing of the lower limit (88 cm), of the chest measurement range in the JIS standard. Table 2 shows the measurements and evaluation results.

Comparative Example 2

The clothing 1 represented by the front view of FIG. 1 and the rear view of FIG. 2 was manufactured. The back body 3 was composed of the back body parts 3*a* of one piece with no cutting out portion 9 formed. A single tricot fabric of 100% polyester was used as the material of the clothing 1, and the elongations 3 of the material in the body length direction and the width direction were 130% and 50%, respectively; the elastic recovery of elongation in the body length direction and the width direction were 80% and 75%, respectively; and the ratio of the elongations 3 was 0.38.

Patterns of the front body parts 2*a*, the back body parts 3*a*, the sleeve 4, and the neck 5 of size M for men were prepared and marked such that the body length direction of the material was the body length direction of each part and the sleeve 4, and cutting was carried out.

The measurement of the chest width 6 of the front body 2 was set at 41 cm so that the elongation 1 was 12% relative to 92 cm which is the intermediate value of the chest measurement range of size M (88 to 96 cm) according to the designation by range in JIS L 4004 (2001). The measurement of the chest width 7 of the back body 3 was set at 42.5 cm so that the elongation 2 was 8%.

The front body parts 2*a*, the back body parts 3*a*, the sleeve 4, and the neck 5 obtained were joined by sewing at the joint region 8 as shown in FIG. 1 and FIG. 2 using a flat seamer sewing machine to form the clothing 1.

The clothing obtained was evaluated for posture improvability, motion followability, and wearing comfort according to the evaluation criteria in Table 1. The loads for stretching 1 and 2 of the clothing were 130 gf/cm (127,400 dyn/cm) and 120 gf/cm (117,600 dyn/cm), respectively. The ratio of the chest width 6 of the front body 2 to the chest width 7 of the back body 3 was 0.8, and the sum of the chest width 6 of the front body 2 and the chest width 7 of the back body 3 was 83.5 cm, which was below the lower limit (88 cm) of the chest measurement in the JIS standard. Table 2 shows the measurements and evaluation results.

TABLE 2

| | | Example 1 | Example 2 | Example 3 | Comparative Example 1 |
|---|---|---|---|---|---|
| Constitution | Materials | Plain knit/ polyester 88%, polyurethane 12% | Plain knit/ cotton 51%, acrylic 24%, rayon 20%, polyurethane 5% | Plain knit/ polyester 88%, polyurethane 12% | Plain knit/ polyester 88%, polyurethane 12% |
| | The chest width of the back body compared to the chest width of the front body | The chest width of the back body is shorter than the chest width of the front body | The chest width of the back body is shorter than the chest width of the front body | The chest width of the back body is shorter than the chest width of the front body | the same length |
| | Ratio of the chest width of the front body to the chest width of the back body (Chest width of front body/ Chest width of back body) | 1.14 | 1.38 | 1.14 | 1 |
| | Total measurement of the chest width of the front body and the chest width of the back body compared to the standard clothing size | Total measurement is shorter than the standard clothing size | Total measurement is shorter than the standard clothing size | Total measurement is shorter than the standard clothing size | Total measurement is longer than the standard clothing size |
| | Joint region position of cutting out portion | between the left and right scapulae from the superior angle to the waist: 1 location | from the superior angle to the angulus inferior of the left and right scapulae: 2 locations | none | none |
| Measurement results | Elongation 1 (%) | 18 | 39 | 18 | −16 |
| | Elongation 2 (%) | 53 | 59 | 53 | −16 |
| | Elongation stress 1 (gf/cm) | 12 | 32 | 12 | 0 |
| | Elongation stress 2 (gf/cm) | 40 | 48 | 40 | 0 |
| | Elongation 3 (%) Body length direction/ Chest width direction | 120/150 | 70/90 | 120/150 | 120/150 |
| | Ratio of the elongation 3 | 1.25 | 1.28 | 1.25 | 1.25 |
| | Elastic recovery of elongation (%) Body length direction/ Chest width direction | 91/93 | 80/86 | 91/93 | 91/93 |
| | Rate of change in distance between angulus inside scapulae point (%) | −33 | −20 | −15 | 0 |
| Evaluation results (*1) | Posture Improvability | 13 | 15 | 9 | −10 |
| | Motion Followability | 18 | 13 | 10 | 7 |
| | Wearing Comfort | 14 | 11 | 9 | 20 |
| | Comprehensive evaluation | 45 | 39 | 28 | 7 |

(*1) The total evaluation score of the 10 test users

The clothing of Examples 1 to 3 was configured such that the chest width 7 of the back body 3 was shorter than the chest width 6 of the front body 2, whereby the clothing was excellent in posture improvability to draw left and right scapulae to the rear central part of a human body.

The clothing of Example 1 had a stretching stress 1 at the elongation 1 in the range of 1 to 30 gf/cm (980 to 29,400 dyn/cm) and a stretching stress 2 at the elongation 2 in the range of 20 to 100 gf/cm (19,600 to 98,000 dyn/cm), and therefore was superior in wearing comfort to the clothing of the Example 2 whose stretching stress 1 at the elongation 1 was over 30 gf/cm (29,400 dyn/cm).

The clothing of Examples 1 to 3, wherein the elongation 3 at 14.7 N elongation of the clothing material was 70% or more in the chest width direction, was superior in motion followability to the clothing of Comparative Example 2 whose elongation 3 was less than 70% in the chest width direction. Further, the clothing of Example 1 had an elongation 3 in the chest width direction larger than that of the clothing of the Example 2 and, therefore, had a higher motion followability.

Further, the clothing of Examples 1 and 2, wherein the joint region of the cutting out portion 9 lay from the superior angle between left and right scapulae to the waist, was superior in all of the posture improvability, motion followability, and wearing comfort to the clothing of Example 3, wherein the joint region of the cutting out portion 9 did not exist and the shape of the upper end of a side line and the lower end of an armhole was changed.

The clothing of Comparative Example 1, wherein the lengths of the chest width 6 of the front body 2 and the chest width 7 of the back body 3 were the same, had ease in total measurement of the chest width 3 of the front body 2 and the chest width 7 of the back body 3 and had a high wearing comfort, but had no posture improvability.

The clothing of Comparative Example 2, although the total measurement of the chest width 6 of the front body 2 and the chest width 7 of the back body 3 were below the lower limit of the chest or bust measurement of the clothing size specified in the JIS standard, was configured such that the chest width 7 of the back body 3 was longer than the chest width 6 of the front body 2 and, therefore, was not capable of drawing left and right scapulae to the rear central part of a human body and had no posture improvability.

INDUSTRIAL APPLICABILITY

Our clothing guides the motion or state of the upper body of a wearer to a proper posture, and can be used as a functional clothing that reduces tension of muscles around scapulae.

The invention claimed is:

1. Clothing having a body including a front body and a back body, wherein 1) a material constituting the front body and a material constituting the back body are the same, 2) a chest width of the back body is shorter than a chest width of the front body, 3) the back body is composed of a plurality of back body parts joined, 4) the plurality of back body parts has such a shape that a cutting out portion is formed when these back body parts are arranged in a plane without being joined, and when the plurality of back body parts is joined, a joint region closing the cutting out portion is configured to pass from superior angle of scapula to angulus inferior scapulae of a human body between the left scapula and the right scapula, and 5) a ratio of the chest width of the front body to the chest width of the back body (chest width of front body/chest width of back body) is 1.1 or more.

2. The clothing according to claim 1, wherein an elongation 2 defined below of the back body is greater than an elongation 1 defined below of the front body, and in the materials constituting the front body and the back body, a stretching stress 2 in the chest width direction at the elongation 2 is greater than a stretching stress 1 in the chest width direction at the elongation 1:

Elongation 1(%)={(intermediate value in chest or bust measurement range of a specific clothing size specified in a specific clothing standard/2)−chest width of front body}/chest width of front body×100; and Elongation 2(%)={(intermediate value in chest or bust measurement range of a specific clothing size specified in a specific clothing standard/2)−chest width of back body}/chest width of back body×100, wherein "a specific clothing size specified in a specific clothing standard" is a clothing standard and a clothing size used as a standard in designing the clothing according to any of JIS L 4002 (1997), JIS L 4003 (1997), JIS L 4004 (2001), JIS L 4005 (2001), JIS L 4006 (1998) and JASPO.

3. The clothing according to claim 2, wherein the stretching stress 1 at elongation 1 is 1 to 30 gf/cm (980 to 29,400 dyn/cm), and the stretching stress 2 is 20 to 100 gf/cm (19,600 to 98,000 dyn/cm).

4. The clothing according to claim 1, wherein the fabric constituting the front body and the back body have an elongation 3 determined according to JIS L 1096 (2010) in the chest width direction at 14.7 N elongation of 70% or more.

5. The clothing according to claim 1, wherein a ratio of an elongation 3 determined according to JIS L 1096 (2010) in the chest width direction to the elongation 3 in the body length direction at 14.7 N elongation (elongation 3 in chest width direction/elongation 3 in body length direction) of the materials constituting the front body and the back body is 0.5 to 2.0.

6. The clothing according to claim 1, wherein the materials constituting the front body and the back body have an elastic recovery of elongation after 14.7 N elongation of 85 to 100% in the chest width direction.

7. The clothing according to claim 1, wherein the total measurement of the chest width of the front body and the chest width of the back body is lower than the lower limit of a chest or bust measurement range of a specific clothing size specified in a specific clothing standard;

wherein "a specific clothing size specified in a specific clothing standard" is a clothing standard and a clothing size used as a standard in designing the clothing according to any of JIS L 4002 (1997), JIS L 4003 (1997), JIS L 4004 (2001), JIS L 4005 (2001), JIS L 4006 (1998) and JASPO.

8. The clothing according to claim 2, wherein the fabric constituting the front body and the back body have an elongation 3 determined according to JIS L 1096 (2010) in the chest width direction at 14.7 N elongation of 70% or more.

9. The clothing according to claim 3, wherein the fabric constituting the front body and the back body have an elongation 3 determined according to JIS L 1096 (2010) in the chest width direction at 14.7 N elongation of 70% or more.

10. The clothing according to claim 1, wherein the ratio of the elongation 3 in the chest width direction to the elongation 3 determined according to JIS L 1096 (2010) in the body length direction at 14.7 N elongation (elongation 3 determined according to JIS L 1096 (2010) in chest width direction/elongation 3 determined according to JIS L 1096 (2010) in body length direction) of the fabric constituting the front body and the back body is 0.5 to 2.0.

11. The clothing according to claim 1, wherein the ratio of the elongation 3 in the chest width direction to the elongation 3 in the body length direction at 14.7 N elongation (elongation 3 determined according to JIS L 1096 (2010) in chest width direction/elongation 3 determined according to JIS L 1096 (2010) in body length direction) of the fabric constituting the front body and the back body is 0.5 to 2.0.

12. The clothing according to claim 2, wherein the ratio of the elongation 3 in the chest width direction to the elongation 3 in the body length direction at 14.7 N elongation (elongation 3 determined according to JIS L 1096 (2010) in chest width direction/elongation 3 determined according to JIS L 1096 (2010) in body length direction) of the fabric constituting the front body and the back body is 0.5 to 2.0.

13. The clothing according to claim 3, wherein the ratio of the elongation 3 in the chest width direction to the elongation 3 in the body length direction at 14.7 N elongation (elongation 3 determined according to JIS L 1096 (2010) in chest width direction/elongation 3 determined according to JIS L 1096 (2010) in body length direction) of the fabric constituting the front body and the back body is 0.5 to 2.0.

* * * * *